US010065440B2

(12) United States Patent
Kitajima

(10) Patent No.: US 10,065,440 B2
(45) Date of Patent: Sep. 4, 2018

(54) IMAGE RECORDING APPARATUS AND ADDITIONAL CASSETTE DEVICE

(71) Applicant: Tetsuya Kitajima, Aichi (JP)

(72) Inventor: Tetsuya Kitajima, Aichi (JP)

(73) Assignee: BROTHER KOGYO KABUSHIKI KAISHA, Nagoya, Aichi (JP)

( * ) Notice: Subject to any disclaimer, the term of this patent is extended or adjusted under 35 U.S.C. 154(b) by 629 days.

(21) Appl. No.: 13/628,973

(22) Filed: Sep. 27, 2012

(65) Prior Publication Data

US 2013/0107456 A1 May 2, 2013

(30) Foreign Application Priority Data

Oct. 31, 2011 (JP) ..... 2011-239350

(51) Int. Cl.
*G03G 21/20* (2006.01)
*B41J 29/377* (2006.01)
*B41J 13/10* (2006.01)

(52) U.S. Cl.
CPC ..... *B41J 29/377* (2013.01); *B41J 13/103* (2013.01); *G03G 21/206* (2013.01)

(58) Field of Classification Search
CPC ..... B65H 1/04; B65H 2405/332; B65H 2406/121; B65H 2406/1211; B65H 2406/4212; B65H 2515/41; B65H 2515/40; G03G 21/20
USPC ..... 399/92, 107, 361, 388; 271/9.01, 9.11, 271/264; 358/474, 488
See application file for complete search history.

(56) References Cited

U.S. PATENT DOCUMENTS 5,671,466 A * 9/1997 Hokamura ..... B65H 3/0661 271/242
5,907,745 A * 5/1999 Azuma et al. ..... 399/92
6,000,870 A * 12/1999 Koga ..... B41J 11/50 271/145
6,226,475 B1 5/2001 Kabumoto et al.
(Continued)

FOREIGN PATENT DOCUMENTS

CN 1246664 A 3/2000
JP H07-134534 A 5/1995
(Continued)

OTHER PUBLICATIONS

Notice of Allowance dated Jun. 3, 2014 in U.S. Appl. No. 13/628,981.
(Continued)

*Primary Examiner* — Thomas A Morrison
(74) *Attorney, Agent, or Firm* — Scully, Scott, Murphy & Presser, P.C.

(57) ABSTRACT

An image recording apparatus, comprising: a recording device; a cassette; a discharge tray; a conveying path; a conveyor; an electrical power supply; a cooling air flow path; an air blower configured to apply a wind-force to air so as to cause the air to flow through the cooling air flow path; and a casing, wherein: the electrical power supply and the cooling air flow path are arranged in a lower region in a vertical direction with respect to the cassette, the conveying path and the recording device; the recording device is located, in regard to the vertical direction, at a position higher than or equal to the cassette; and the electrical power supply and the cassette overlap each other in the vertical direction.

20 Claims, 8 Drawing Sheets

(56) References Cited

U.S. PATENT DOCUMENTS

| | | | | |
|---|---|---|---|---|
| 6,344,869 | B2 | 2/2002 | Sasaki et al. | |
| 6,415,118 | B1 | 7/2002 | Setoriyama et al. | |
| 6,473,152 | B1 * | 10/2002 | Yokota | 355/30 |
| 7,599,641 | B2 | 10/2009 | Yoshihara et al. | |
| 2001/0053300 | A1 | 12/2001 | Endo et al. | |
| 2004/0096229 | A1 | 5/2004 | Yoshihara et al. | |
| 2004/0234291 | A1 | 11/2004 | Iikawa et al. | |
| 2006/0114654 | A1 | 6/2006 | Kiyosumi | |
| 2011/0242188 | A1 | 10/2011 | Sakano | |

FOREIGN PATENT DOCUMENTS

| | | | |
|---|---|---|---|
| JP | 7-140818 | | 6/1995 |
| JP | H11-161116 | A | 6/1999 |
| JP | 11-305637 | | 11/1999 |
| JP | 2000-211209 | A | 8/2000 |
| JP | 2000-275923 | A | 10/2000 |
| JP | 2001-337499 | A | 12/2001 |
| JP | 2001-353899 | A | 12/2001 |
| JP | 2002-344163 | A | 11/2002 |
| JP | 2004/093708 | A | 3/2004 |
| JP | 2004-272089 | A | 9/2004 |
| JP | 2004-341374 | A | 12/2004 |
| JP | 2006-154462 | A | 6/2006 |
| JP | 2009-116092 | | 5/2009 |
| JP | 2009-198681 | | 9/2009 |
| JP | 2011-212886 | A | 10/2011 |

OTHER PUBLICATIONS

U.S. Office Action dated Oct. 30, 2013 from related U.S. Appl. No. 13/628,981.

Extended European Search Report and Search Opinion dated Feb. 21, 2013 from related Application No. 12186287.4.

Notification of First Office Action dated Aug. 5, 2014 received from the Chinese Patent Office in CN application No. 201210375863.8 together with English language translation.

Notification of Reasons for Rejection dated Aug. 18, 2015 received in related application JP 2011-239350 together with an English language translation.

Notification of Reasons for Rejection dated Sep. 15, 2015 received in related Japanese application JP 2011-239351, together with an English language translation.

Decision of Rejection dated Apr. 12, 2016 received in related Japanese application JP 2011-239351, together with an English language translation.

* cited by examiner

IMAGE RECORDING APPARATUS AND ADDITIONAL CASSETTE DEVICE

CROSS-REFERENCE TO RELATED APPLICATION

This application claims priority under 35 U.S.C. § 119 from Japanese Patent Application No. 2011-239350, filed on Oct. 31, 2011. The entire subject matter of the application is incorporated herein by reference.

BACKGROUND

Technical Field

Aspects of the present invention relate to an image recording apparatus having a conveying path along which a recording medium is carried, and a cooling air flow path along which air for cooling an electrical power supply flows.

Related Art

An image forming apparatus which includes a conveying path along which a sheet-like medium is conveyed, and a flowing path along which air for cooling an electrical power supply flows is known. The image forming apparatus of this type is configured such that outside air is taken into a main body of the image forming apparatus through a first air intake, and the electrical power supply is cooled by the outside air, by rotating a fan. The outside air is sucked by the fan through a plurality of ventilation holes formed in a sheet carrying guide, and is discharged to the outside through an air outlet provided on a downstream side of the fan. The sheet-like medium accommodated in a paper supply cassette is carried to a space where image formation is performed by an optical writing unit while being guided along the conveying path. The sheet-like medium on which an image has been formed is ejected to a discharge tray while being guided along the sheet carrying guide having the plurality of ventilation holes. Therefore, regarding the image forming apparatus, there is a concern that the conveying path for the sheet-like medium and the flowing path of the air intersect with each other, and the air flowing through the flowing path badly affects carrying of the sheet-like medium.

SUMMARY

Aspects of the present invention are advantageous in that they provide at least one of an image recording apparatus and an additional cassette device configured to prevent air for cooling an electrical power supply from badly affecting carrying of a recording medium.

According to an aspect of the invention, there is provided an image recording apparatus, comprising: a recording device configured to record an image on a recording medium in a recording space, the recording space being defined facing the recording device; a cassette configured to accommodate the recording medium on which the image is to be recorded by the recording device; a discharge tray configured to stack the recording medium on which the image has been formed by the recording device; a conveying path along which the recording medium is conveyed from the cassette to the discharge tray via the recording space; a conveyor configured to apply, to the recording medium, a conveying force for conveying the recording medium along the conveying path; an electrical power supply that applies electrical power at least to the conveyor; a cooling air flow path through which air for cooling the electrical power supply flows; an air blower configured to apply a wind-force to air so as to cause the air to flow through the cooling air flow path; and a casing that accommodates the recording device, the cassette, the conveying path, the conveyor, the electrical power supply and the cooling air flow path. In this configuration, the electrical power supply and the cooling air flow path are arranged in a lower region in a vertical direction with respect to the cassette, the conveying path and the recording device. The recording device is located, in regard to the vertical direction, at a position higher than or equal to the cassette. The electrical power supply and the cassette overlap each other in the vertical direction.

With this configuration, it becomes possible to prevent air for cooling an electrical power supply from badly affecting carrying of a recording medium.

BRIEF DESCRIPTION OF THE ACCOMPANYING DRAWINGS

DETAILED DESCRIPTION

Hereafter, an embodiment according to the invention will be described with reference to the accompanying drawings.

Figure 1:
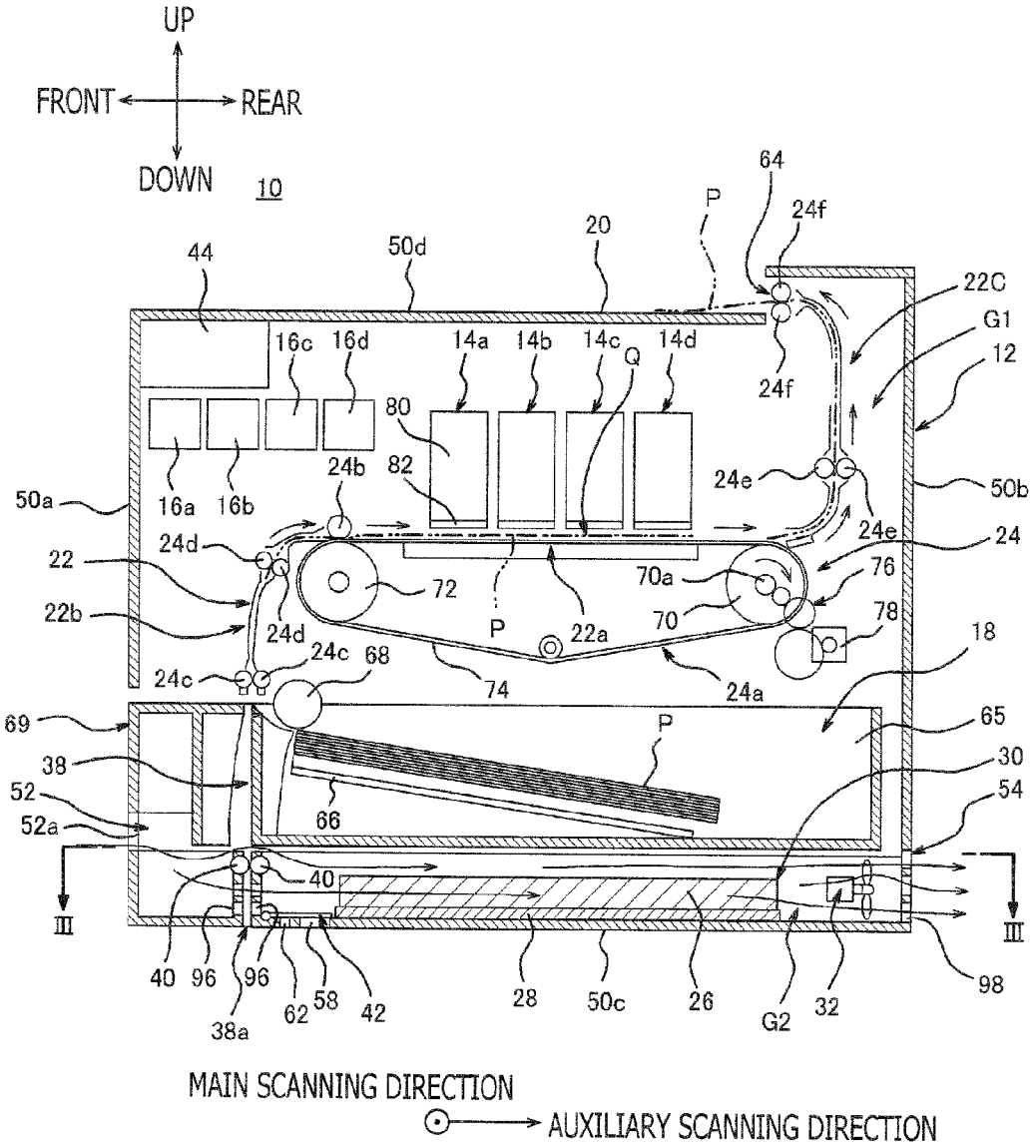
FIG. 1 is a schematic diagram generally illustrating a configuration of an inkjet printer according to an embodiment.

As shown in FIG. 1, an image recording apparatus according to the embodiment is an inkjet printer 10 in which ink ejection heads 14*a* to 14*d* are employed as "a recording device" and a sheet of paper P is used as "a recording medium".

As shown in FIG. 1, the inkjet printer 10 according to the embodiment includes an additional cassette device 34 as an accessory unit, and is configured such that a user is able to select whether to attach the additional cassette device 34 to the inkjet printer 10 at the user's discretion depending on usage. Therefore, at first, the configuration of the inkjet printer 10 to which the additional cassette device 34 is not attached is explained, and then the configuration of the inkjet printer 10 to which the additional cassette device 34 is attached is explained. In the following explanations, an "upper side" means an upper side in the vertical direction, and a "lower side" means a lower side in the vertical direction. The front and rear direction is defined with reference to a direction along which the user views. That is, a "front side" means a near side viewed from the user, and a "rear side" means a back side viewed from the user. In this embodiment, the left side of FIG. 1 corresponds to the front side.

(Configuration of Inkjet Printer to Which Additional Cassette Device is Not Attached)

As shown in FIG. 1, the inkjet printer 10 is configured to record an image on the sheet of paper P at a predetermined recording space Q. The inkjet printer 10 includes ink ejection heads 14*a* to 14*d*, ink tanks 16*a* to 16*d* for storing ink, a cassette 18 which accommodates the sheets of paper P, a discharge tray 20 to which the sheet of paper P on which an image has been formed by the ink ejection heads 14*a* to 14*d* is ejected, a conveying path 22 along which the sheet of paper is conveyed from the cassette 18 to the discharge tray 20 via the predetermined recording space Q, and a conveyer 24 configured to apply, to the sheet of paper P, conveying force for conveying the sheet of paper P along the conveying path 22.

As shown in FIG. 1, the inkjet printer 10 includes an electrical power supply 26 which supplies electrical power at least to the conveyer 24, a heatsink 28 which serves to radiate heat from the electrical power supply 26, a cooling air flow path 30 along which air for cooling the electrical power supply 26 flows, and an air blower 32 which applies wind-force to the air so that the air flows through the cooling air flow path 30.

Furthermore, as shown in FIG. 1, the inkjet printer 10 includes a relay path 38 through which the conveying path 22 communicates with an additional conveying path 36 of the additional cassette device 34 (see FIG. 4), a pair of carrying rollers 40 which applies conveying force to the sheet of paper P to carry the sheet of paper P along the relay path 38, and an air intake switch device 42 which performs switching to introduce air into the cooling air flow path 30 from one of a first air intake 96 and a second air intake 59, and a control unit 44 which controls various components in the inkjet printer 10.

As shown in FIG. 1, a casing 12 serves as a housing for accommodating the above described components, and is configured to have a shape of a long rectangular parallelepiped in the front and rear direction by a front wall part 50*a*, a rear wall part 50*b*, a bottom part 50*c*, a ceiling part 50*d*, a left wall part 50*e* (see FIG. 3) and a right wall part 50*f*. As described later, the sheet of paper P is carried from the front side to the rear side in the predetermined recording space Q. Therefore, each of the front wall pat 50*a* and the rear wall part 50*b* extends in a direction perpendicular to a conveying direction of the sheet of paper P in the predetermined recording space Q.

Figure 2:
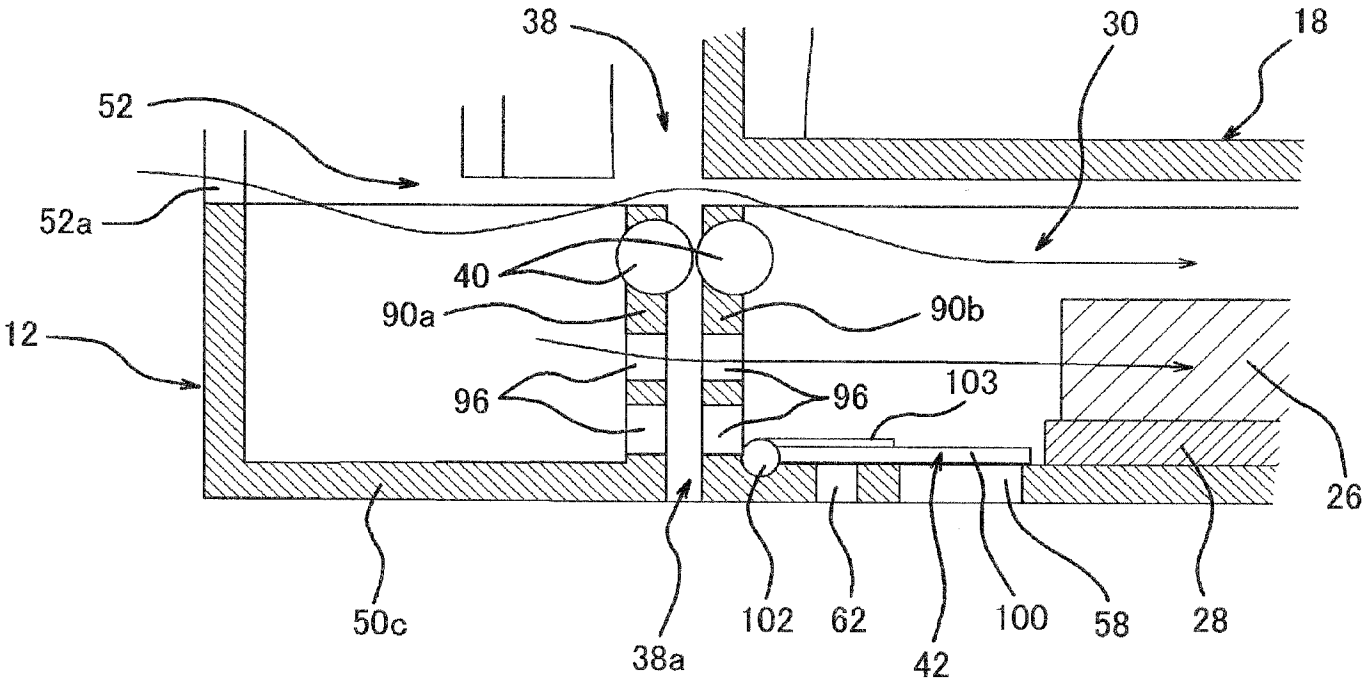
FIG. 2 is an enlarged view illustrating a relay path and an air intake path.

As shown in FIG. 1, an upstream side opening 52*a* of an air intake path 52 for allowing air outside the casing 12 to flow into the cooling air flow path 30 through a region where the relay path 38 is provided is formed in the front wall part 50*a* of the casing 12. A discharge opening 54 for the air flowing through the cooling air flow path 30 is formed in the rear wall part 50*b* of the casing 12. As shown in FIG. 2, in the bottom part 50*c* of the casing 12, an entrance part 38*a* of the relay path 38, a second air intake 58 for allowing the air supplied from an additional cooling air flow path 56 (see FIG. 4) to flow into the cooling air flow path 30 and a through hole 62 to which an operation pin 60 (see FIG. 5) of the additional cassette device 34 (FIG. 4) is inserted are provided. Furthermore, as shown in FIG. 1, on the ceiling part 50*d* of the casing 12, a paper ejection opening 64 through which the sheet of paper P is ejected frontward is provided. A part of the top surface of the casing 12 located on the front side of the paper ejection opening 64 is formed as the ejection part 20 to which the sheet of paper P is ejected.

As shown in FIG. 1, in a region lower than the central portion of the casing 12 in the vertical direction, the cassette 18 having a quadrangular shape when viewed as a plan view (see FIG. 3) is arranged horizontally. The inner space of the casing 12 is divided into a first region G1 located on the upper side of the cassette 18, and a second region G2 located on the lower side of the cassette 18. In the first region G1, the ink ejection heads 14*a* to 14*d*, the ink tanks 16*a* to 16*d*, the conveying path 22, the conveyer 24, and the control unit 44 are arranged. In the second region G2, the electrical power supply 26, the heatsink 28, the cooling air flow path 30, the air blower 32, the relay path 38, the pair of carrying rollers 40 and the air intake switch device 42 are provided.

As shown in FIG. 1, the cassette 18 is a tray-like container having a shape elongated in the conveying direction of the sheet of paper P in the predetermined recording space Q. The cassette 18 includes a container body 65 which accommodates a stack of sheets of paper P, a support plate 66 which supports the sheet of paper P in the inside of the container body 65 and a spring (not shown) which presses upward the front of the support plate 66. At a portion in the front wall part 50*a* of the casing 12 corresponding to the cassette 18, an insertion hole 69 is formed so that the cassette 18 can be detachably attachable to the inside of the casing 22 through the insertion hole 69. In the state where the cassette 18 is inserted into the inside of the casing 12, a gap is formed between the insertion hole 69 and the cassette 18, and the gap is the upstream side opening 52*a*.

As shown in FIG. 1, the conveying path 22 is constituted by a horizontal path 22*a* for carrying the sheet of paper P in the horizontal direction in the predetermined recording space Q, a supply path 22*b* for carrying the sheet of paper P accommodated in the cassette 18 to the horizontal path 22*a*, and a discharge path 22*c* for carrying the sheet of paper P which has passed the horizontal path 22*a* to the discharge tray 20, to thereby have a shape of a letter "S". Along the conveying path 22, components forming the conveyer 24 are arranged.

As shown in FIG. 1, the conveyer 24 includes a carrying unit 24*a* which applies conveying force to the sheet of paper P for carrying the sheet of paper P on the horizontal path 22*a*, a supply roller 24*b* which supplies the sheet of paper P to the carrying unit 24*a* at a predetermined timing, carrying rollers 24*c* and 24*d* which apply the conveying force to the sheet of paper P for carrying the sheet of paper P along the supply path 22*b*, carrying rollers 24*e* and 24*f* which apply the conveying force to the sheet of paper P for carrying the sheet of paper P along the discharge path 22*c*, and a pick-up roller 68 which picks ups the sheet of paper P in the cassette 18 one by one and supplies the sheet of paper P to the supply path 22*b*. The carrying unit 24*a* includes a drive pulley 70, a driven pulley 72, an endless belt provided to extend between the pulleys 70 and 72, and a drive motor 78 connected to a rotation shaft 70*a* of the drive pulley 70 via a gear unit 76. The drive motor 78 of the carrying unit 24*a*, a drive motor (not shown) for the supply roller 24*b*, a drive motor (not shown) for the carrying rollers 24*c*, 24*d*, 24*e* and 24*f* and a drive motor for the pick-up roller 69 are electrically connected to the electrical power supply 26 and the control unit 44.

In FIG. 1, the rotation direction of each of the drive pulley 70 and the endless belt 74 is the clockwise direction, and the sheet of paper P is carried from the front side to the rear side in the predetermined recording space Q. That is, the conveying direction of the sheet of paper P in the predetermined recording space Q is equal to the direction in which the cassette 18 is inserted from the insertion hole 69 and the direction in which the air is introduced from the upstream side opening 52*a*. As shown in FIG. 1, in this embodiment, the central portion of the horizontal path 22*a* in the front and rear direction is located at the predetermined recording space Q, and the ink ejection heads 14*a* to 14*d* are located on the upper side of the predetermined recording space Q. Therefore, as shown in FIG. 3, the conveying direction of the sheet of paper P in the predetermined recording space Q is the "auxiliary scanning direction", and the direction perpendicular to the auxiliary scanning direction is the "main scanning direction".

As shown in FIG. 1, each of the ink ejection heads 14*a* to 14*d* has a rectangular parallelepiped head holder 80 (FIG. 3) extending in the main scanning direction, and an ejection head 82 provided to extend in the main scanning direction on the lower surface of the head holder 80. In addition, the ink tanks 16*a* to 16*d* respectively storing ink of difference colors (magenta, cyan, yellow, black) are provided for the ink jet heads 14*a* to 14*d*, respectively. That is, the inject printer 10 according to the embodiment is a line-type color printer. As shown in FIG. 3, each of the ink jet heads 14*a* to 14*d* is arranged to overlap with the cassette 18 when viewed along the vertical direction so that the ink leaking from the ink ejection heads 14*a* to 14*d* is received by the cassette 18. The ejection heads 82 of the respective ink jet heads 14*a* to 14*d* are electrically connected to the electrical power supply 26 and the control unit 44. The ejection head 82 includes a piezoelectric actuator having a known structure driven by a driving voltage.

Figure 3:
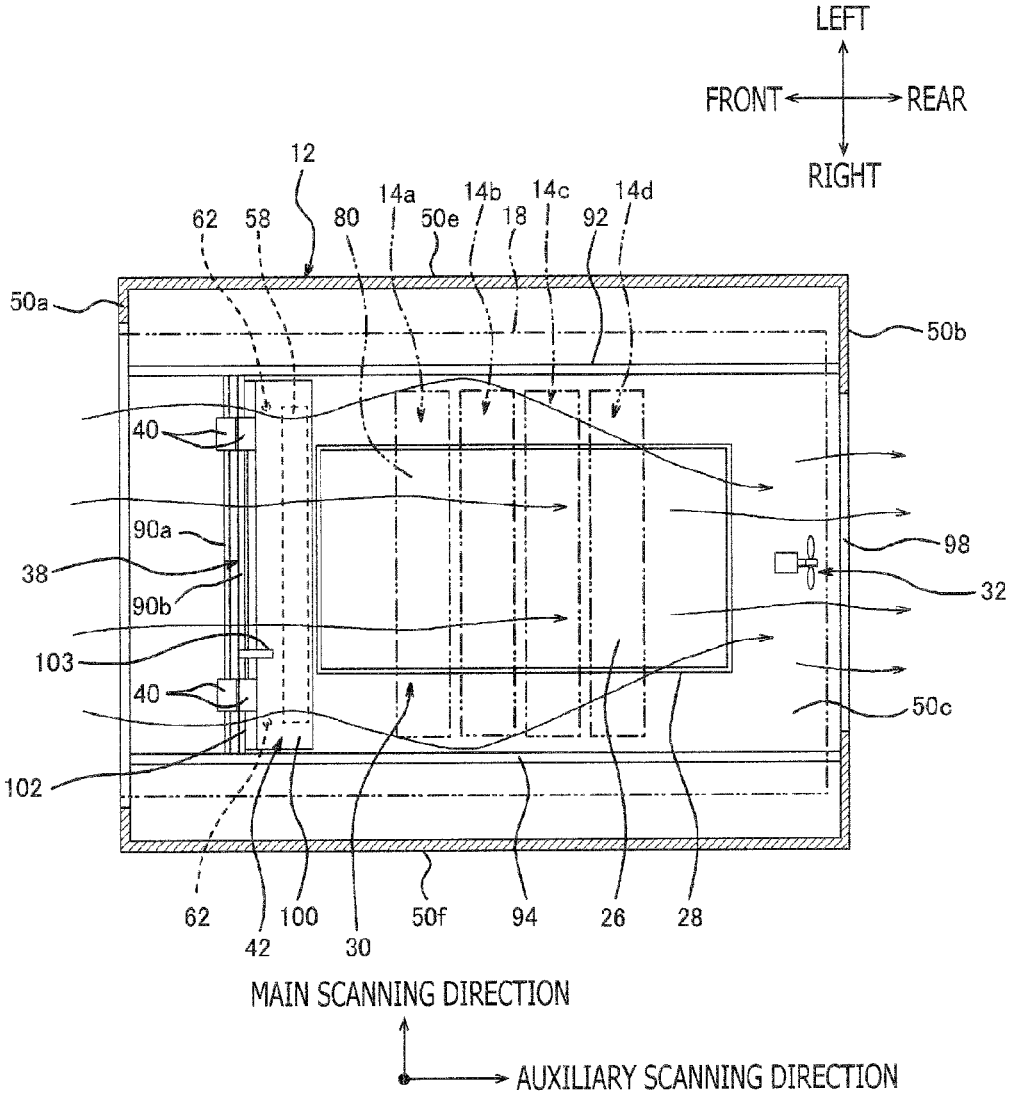
FIG. 3 is a cross-sectional viewed along a line III-III in FIG. 1, illustrating flowing of air introduced into a cooling air flow path from a first air intake.

As shown in FIG. 3, the electrical power supply 26 supplies power to the various electric components, and includes a substrate and a power supply circuit (not shown) provided on the substrate. The electrical power supply 26 according to the embodiment has a quadrangular shape when viewed as a plan view. When viewed along the vertical direction, the electrical power supply 26 is arranged to overlap with the cassette 18. To the electrical power supply 26, the electric components including the conveyer 24, the ink ejection heads 14*a* to 14*d*, the carrying roller 40, the air blower 32 and the control unit 44 are electrically connected.

As shown in FIGS. 1 and 3, the heatsink 28 radiates heat produced in the electrical power supply 26, and is formed to be a quadrangular plate-like member made of metal, such as aluminum. As shown in FIG. 1, the heatsink 28 is arranged on the top face of the bottom part 50*c* of the casing 12, and the electrical power supply 26 is arranged on the top face of the heatsink 28.

As shown in FIG. 1, the cooling air flow path 30 is a path along which the air for cooling the electrical power supply 26 flows. The cooling air flow path 30 is arranged to extend in the direction (i.e., the front and rear direction) equal to the conveying direction of the sheet of paper P in the predetermined recording space Q. As shown in FIG. 3, the cooling air flow path 30 is constituted by the bottom part 50*c* of the casing 12, plate parts 90*a* and 90*b* provided on the front side of the electrical power supply 26, the rear wall part 50*b* of the casing 12, a plate part 92 provided on the left side of the electrical power supply 26, a plate part 94 provided on the right side of the electrical power supply 26, and the cassette 18, to have a shape of a rectangular parallelepiped. The electrical power supply 26 is arranged at the central portion both in the front and rear direction and the left and right direction in the cassette 18.

As shown in FIG. 2, the plate parts 90*a* and 90*b* constitute a part of the relay path 38, and supports the pair of carrying roller 40. In each of the plate parts 90*a* and 90*b*, the slit-like first air intake 96 for introducing the air flowing through the air intake path 52 into the cooling air flow path 30 is formed over the entire length thereof in the left and right direction. In this embodiment, at the upstream end of the predetermined recording space Q in the conveying direction of the sheet of paper P (i.e., at the front part of the casing 12), the air intake 52 is formed to intersect with the relay path 38. The upstream side opening 52*a* is provided at the upstream side end of the air intake path 52, and the first air intake 96 is provided at the downstream side end of the air intake path 52. Therefore, the air introduced from the upstream side opening 52*a* flows through the air intake path 52, and flows into the cooling air flow path 30 from the first air intake 96 via the region where the relay path 38 is provided. Since it is sufficient for the first air intake 96 to have a structure for introducing the air into the region expanding over the entire length in the left and right direction of the cooling air flow path 30, the shape and the number of components of the first air intake 96 may be changed.

As shown in FIG. 3, at the front end part of the cooling air flow path 30 on the bottom part 50*c* of the casing 12, the second air intake 58 having a long rectangular shape for introducing the air of the additional cooling air flow path 56 (FIG. 4) into the cooling air flow path 30 is formed to extend in the left and right direction. Furthermore, as shown in FIG. 3, on the front side of the second air intake 58 at the bottom part 50*c* of the casing 12, and on the rear side of the plat part 90*b*, the air intake switch device 42 for introducing the air from one of the first air intake 96 and the second air intake 58 is provided. As shown in FIGS. 1 and 3, at a portion of the rear wall part 50*b* of the casing 12 corresponding to the cooling air flow path 30, an discharge opening 98 for the air is provided. As shown in FIGS. 1 and 3, at a central portion in the left and right direction of the cooling air flow path 30 and on the rear side of the electrical power supply 26, the air blower 32 configured to suck the air in the cooling air flow path 30 from the rear side of the electrical power supply 26 and to discharge the air through the discharge opening 98 is arranged. As shown in FIG. 2, the entire opening area of the second air intake 58 is larger than the entire opening area of the first air intake 96 formed in the plate part 90*b* forming the cooling air flow path 30. Therefore, in comparison with the case where the air is introduced from the first air intake 96 into the cooling air flow path 30, it is possible to easily introduce a larger amount of air in the case where the air is introduced from the second air intake 58 to the cooling air flow path 30. It should be noted that the entire opening area of an air intake 122 communicating with the additional cooling air flow path 56 is also larger than the entire opening area of the first air intake 96.

As shown in FIG. 2, the air intake switch device 42 blocks the air flowing from one of the first air intake 96 and the second air intake 58 to introduce the air from the other of the first air intake 96 and the second air intake 58. The air intake switch device 42 includes a blocking plate part 100, a support part 102 and a spring 103. The blocking plate part 100 is a plate-like member for selectively blocking one of the first air intake 96 and the second air intake 58. The support part 102 rotatably supports the blocking plate part 100. The spring 103 presses the blocking plate part 100 toward the second air intake 58 side. As shown in FIG. 2, in the state where the additional cassette device 34 is not attached to the casing 12, the blocking plate part 100 is pressed toward the second air intake 58 side by the spring 103, and therefore the second air intake 58 is blocked and the first air intake 96 is opened.

As shown in FIG. 3, the air blower 32 applies wind-force to the air to flow along the cooling air flow path 30. In this embodiment, a fan is employed as the air blower 32. However, it should be noted that the number of air blowers are not limited. Therefore, in another embodiment, a plurality of air blowers may be employed.

As shown in FIG. 3, in this embodiment, the cooling air flow path 30 is formed to have a shape of a rectangular parallelepiped extending in a direction equal to the conveying direction of the sheet of paper P in the predetermined recording space Q (FIG. 1). The air is introduced from one of the first air intake 96 and the second air intake 58 into the entire region in the left and right direction of the front part of the cooling air flow path 30. The air in the cooling air flow path 30 is sucked by the air blower 32 arranged at the central portion in the left and right direction in the rear part of the cooling air flow path 30. Therefore, as shown in FIG. 3, the air for cooling the electrical power supply 26 flows along the surface of the electrical power supply 26 in a shape of a fan. As a result, it becomes possible to effectively cool the entire electrical power supply 26 regardless of the fact that the number of air blowers is one.

(Configuration of Inkjet Printer to Which Additional Cassette Device is Attached)

Figure 4:
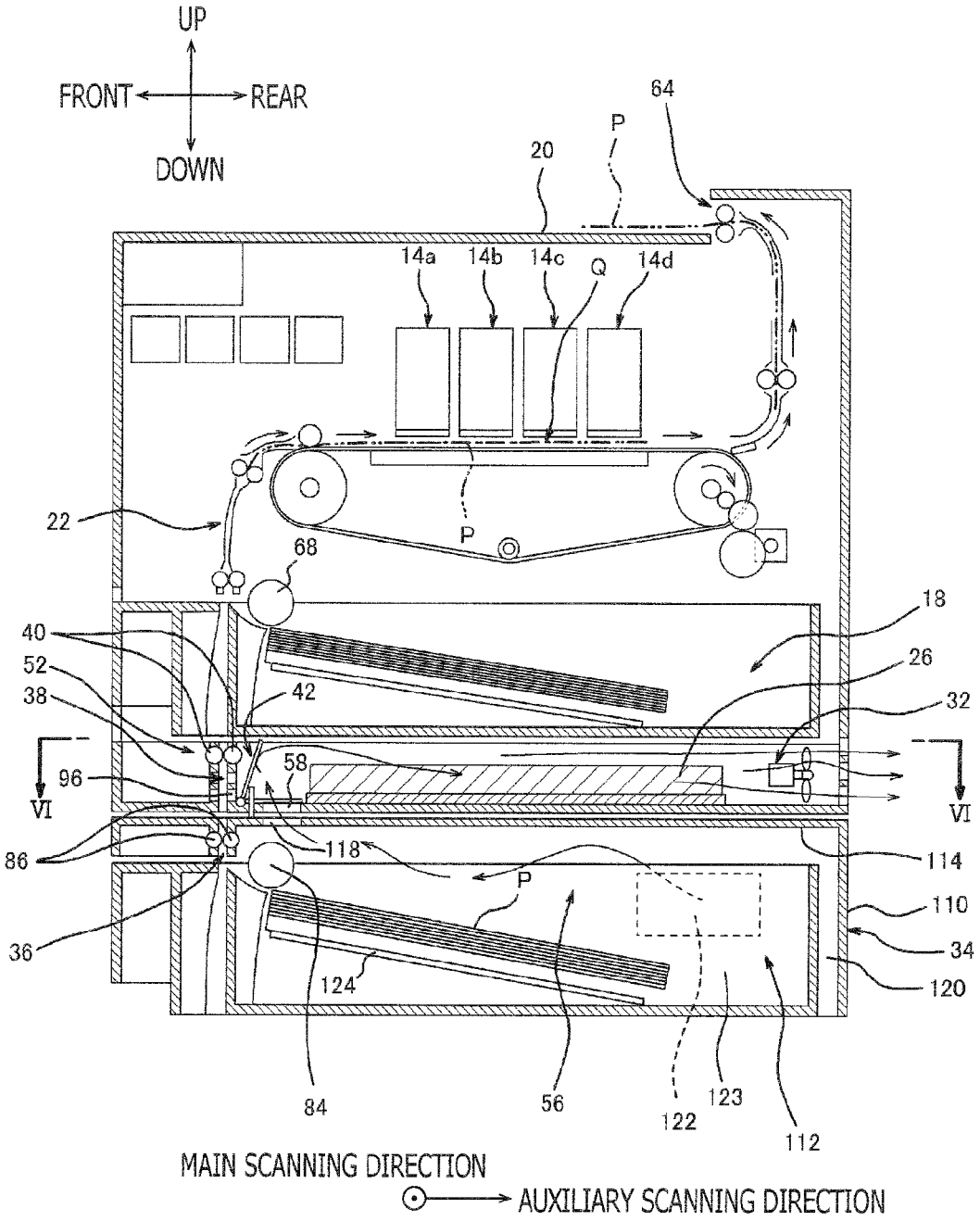
FIG. 4 is a schematic diagram generally illustrating a configuration of the inkjet printer to which an additional cassette device is attached.

As shown in FIG. 4, the additional cassette device 34 is attached to the lower portion of the casing 12, and is an accessory device arranged at the lower portion of the casing 12. The additional cassette device 34 includes an additional casing 110, an additional cassette 112 which accommodates the sheet of paper P on which an image is formed by the ink ejection heads 14*a* to 14*d* functioning as a recording device, the additional conveying path 36 for conveying the sheet of paper P accommodated in the additional cassette 112 to the conveying path 22, and an additional conveyor 85 which applies, to the sheet of paper P, conveying force for conveying the sheet of paper P in the additional conveying path 36, and the additional cooling air flow path 56 along which the air for cooling the electrical power supply 26 flows.

Figure 5:
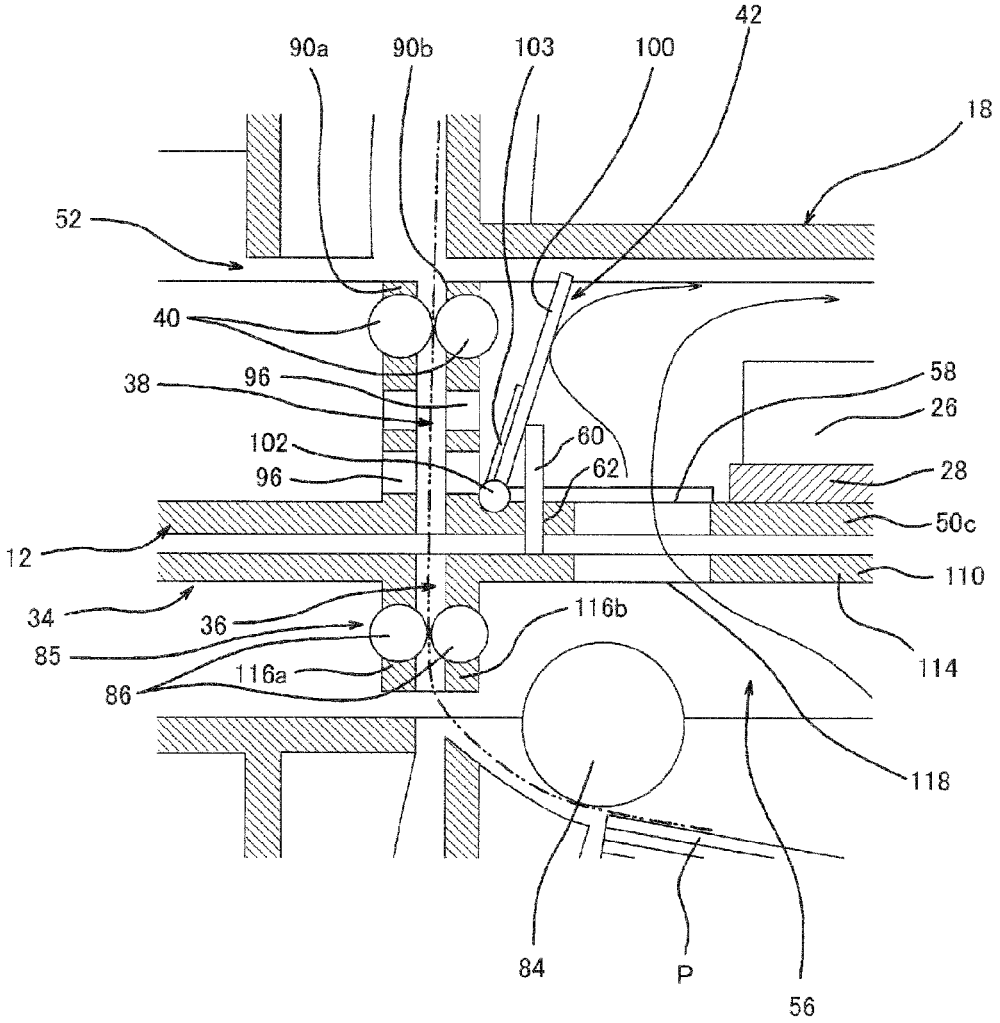
FIG. 5 is an enlarged view illustrating an additional conveying path, a relay path, the air intake path and an air intake switch device.

As shown in FIG. 4, the additional casing 110 is a housing which accommodates the additional cassette 112, the additional conveying path 36 and the additional conveyor 85. As shown in FIG. 5, on a lower surface of a ceiling part 114 of the additional casing 110, two plate parts 116*a* and 116*b* constituting the additional conveying path 36 are formed. To the plate parts 116*a* and 116*b*, a pair of carrying rollers 86 constituting the additional conveyor 85 is attached. As shown in FIG. 4, in the ceiling part 114 of the additional casing 110, an opening 118 communicating with the second air intake 58 is formed to extend in the left and right direction. In a side wall 120 of the additional casing 110, an air intake 122 is formed. Furthermore, in the additional casing 110, the additional cooling air flow path 56 extending from the air intake 122 to the opening 118 is formed. That is, the additional cooling air flow path 56 is formed to communicate with the cooling air flow path 30 while proceeding along a path not to intersect with the additional conveying path 36 and the relay path 38. Furthermore, as shown in FIG. 5, the top surface of the ceiling part 114 of the additional casing 110, the operation pin 60 to be inserted into the through hole 62 is provided.

As shown in FIG. 4, the additional cassette 112 is a tray-like container elongated in the conveying direction of the sheet of paper in the predetermined recording space Q. The additional cassette 112 includes a container body 123 for accommodating a stack of sheets of paper P, a support plate 124 which supports the sheets of paper P in the container body 123, a spring (not shown) which presses upward to the front part of the support plate 124. On the upper side of the front part of the additional cassette 112, a pick-up roller 84 constituting the additional conveyor 85 is arranged.

As shown in FIG. 5, when the additional cassette device 34 is attached to the casing 12, the operation pin 60 is inserted into the through hole 62, the blocking plate 100 is lifted upward by the operation pin 60 against the pressing force from the spring 103. As a result, the second air intake 58 is opened, and the communication between the first air intake 96 and the cooling air flow path 30 is blocked. At this time, the drive motors (not shown) for the respective pick-up roller 84 and the carrying roller 86 are electrically connected to the electrical power supply 26 and the control unit 44. With this configuration, the pick-up roller 84 and the carrying roller 86 are brought to a state of being able to operate based on a signal supplied from the control unit 44.

Figure 6:
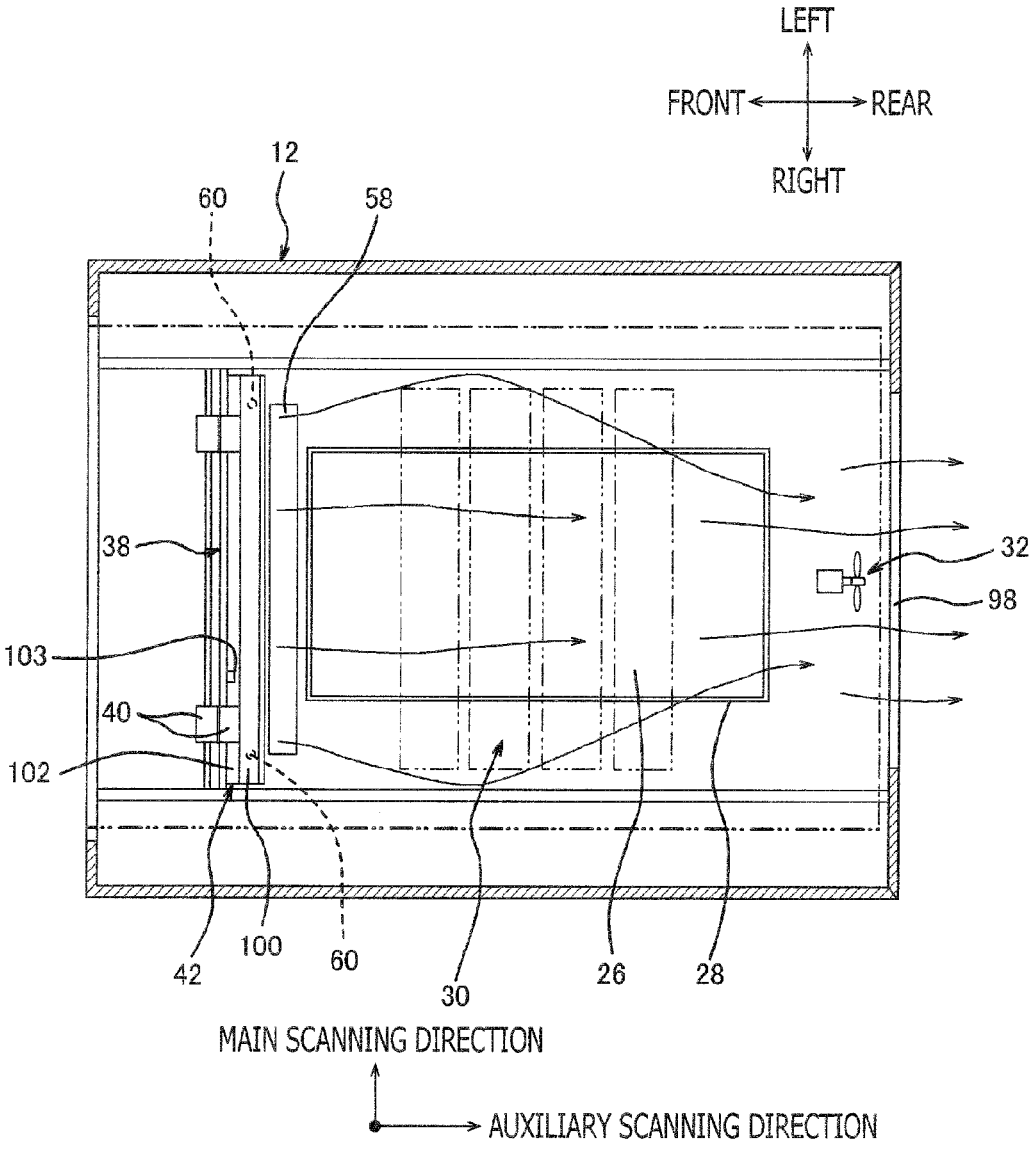
FIG. 6 is a plan view illustrating flowing of air introduced to the cooling air flow path from a second air intake.

As shown in FIG. 6, when a power switch (not shown) of the inkjet printer 10 is turned ON, the air blower 32 is driven by the power supplied form the electrical power supply 26, and the air in the first cooing air flow path 30 is sucked and is discharged from the discharge opening 98. At this time, by the air intake switch device 42, the second air intake 58 is opened and the communication between the first air intake 96 (FIG. 5) and the cooling air flow path 30 is blocked. Therefore, the air in the additional cooling air flow path 56 (FIG. 5) is introduced into the cooling air flow path 30 through the second air intake 58. At this time, the air being introduced into the cooling air flow path 30 does not flows through the air intake 52. Therefore, the air does not pass through the relay path 38.

As shown in FIG. 4, when the printing operation of the inkjet printer 1 is started, the pick-up roller 68 or 84 is driven at a predetermined timing, and the sheet of paper P in the cassette 18 is supplied to the conveying path 22, or the sheet of paper P in the additional cassette 112 is supplied to the conveying path 22 via the additional conveying path 36 and the relay path 38. Then, one of the above described the sheets of paper P is supplied to the predetermined recording space Q, and an image is recorded on the sheet of paper P by ink ejected from the ink ejection heads 14*a* to 14*d*. As a result, the sheet of paper P on which the image has been formed by the ink ejection heads 14*a* to 14*d* is ejected to the discharge tray 20 from the paper ejection opening 64 via the discharge path 22*c* of the conveying path 22. Thereafter, the sheet of paper P on which the image has been formed is ejected to the discharge tray 20 from the paper ejection opening 64 via the conveying path 22 and the discharge path 22*c*.

As shown in FIG. 4, in the state where the additional cassette device 34 is attached to the casing 12, the drive motors (not shown) of the respective pick-up roller 84 and the carrying roller 86 are electrically connected to the electrical power supply 26, so that the power is supplied to the pick-up roller 84 and the carrying roller 86. Therefore, in comparison with the case where the additional cassette device 34 is not attached to the casing 12, the current flowing through the electrical power supply 26 becomes larger and the heat generated by the electrical power supply 26 becomes also larger in the case where the additional cassette device 34 has been attached. For this reason, in the case where the additional cassette device 34 is attached to the casing 12, the control unit 44 controls the air blower 32 to increase the wind-force causing the air to flow along the cooling air flow path 30.

(Advantages of the Invention)

As shown in FIG. 1, in this embodiment, the electrical power supply 26 and the cooling air flow path 30 are accommodated in the second region G2 located in the vertical direction under the cassette 18, the conveying path 22 and the inkjet heads 14*a* to 14*d*, and the air flowing through the cooling air flow path 30 does not hit against the sheet of paper P passing through the conveying path 22. Therefore, it becomes possible to prevent the air from badly affecting the carrying of the sheet of paper P.

As shown in FIG. 3, the electrical power supply 26 is arranged to overlap with the cassette 18 when viewed along the vertical direction. Therefore, the cassette 18 is able to prevent the ink leaking from the inkjet heads 14*a* to 14*d* and dust caused in the conveying path 22 from falling on the electrical power supply 26.

As shown in FIG. 3, since the ink jet heads 14*a* to 14*d* are located to overlap with the cassette 18 when viewed along the vertical direction, it is possible to make the whole device compact in size in the horizontal direction, and the cassette 18 becomes able to prevent the ink leaking from the ink ejection heads 14*a* to 14*d* from falling on the electrical power supply 26.

As shown in FIG. 1, since the conveying path 22 having the horizontal path 22*a*, the supply path 22*b* and the discharge path 22*c* can be formed to be compact and to have a shape of a letter "S", the size of the whole device can be made compact. Furthermore, the conveying path 22 having a form of a letter "S" is arranged in a wide region in the casing 12, and the cooling air flow path 30 is arranged, under the cassette 18 and the conveying path 22, in the second region G2 including an region in which the electrical power supply 26 is provided. Therefore, the air flowing through the cooling air flow path 30 does not hit against the sheet of paper P passing through the conveying path 22.

As shown in FIG. 1, the cassette 18 is formed to be elongated in the direction equal to the conveying direction of the sheet of paper P in the predetermined recording space Q, and the cooling air flow path 30 is arranged to extend in the direction equal to the conveying direction of the sheet of paper P in the predetermined recording space Q. Such a configuration enhances the degree of design freedom of the cooling air flow path 30. For example, it is possible to arrange the cooling air flow path 30 with reference to the electrical power supply 26 without difficulty, and therefore it becomes possible to enhance the cooling property and to downsize the air blower 32.

As shown in FIG. 1, the air blower 32 causes the air in the cooling air flow path 30 to flow in the direction equal to the conveying direction of the sheet of paper P in the predetermined recording space Q. Therefore, it becomes possible to make the direction (i.e., the conveying direction) of flowing of air caused by carrying of the sheet of paper P and the direction (i.e., the air blasting direction) of flowing of air in the cooling air flow path 30 become equal to each other. As a result, even when the air in the cooling air flow path 30 leaks into the first region G1 where the conveying path 22 is arranged, the air is hard to affect the carrying of the sheet of paper P.

As shown in FIG. 4, even when the inkjet printer 10 includes the additional cassette device 34 and the sheet of paper P in the additional cassette 112 is carried to the predetermined recording space Q via the additional conveying path 36, the relay path 38 and the conveying path 22, the air cooling the electrical power supply 26 does not hit against the sheet of paper P passing through the additional conveying path 36 and the relay path 38 and is hard to affect the carrying of the sheet of paper P.

As shown in FIG. 2, in the state where the additional cassette device 34 (FIG. 4) is not attached to the casing 12, the second air intake 58 is blocked by the air intake switch device 42. Therefore, dust is hard to enter the cooling air flow path 30 from the second air intake 58.

As shown in FIG. 5, the opening area of the second air intake 58 is larger than the opening area of the first air intake 96 formed in the plate part 96*b*. Furthermore, in comparison with the case where the additional cassette device 34 is not attached to the casing 12, the wind-force for causing the air to flow in the cooling air flow path 30 is increased in the case where the additional cassette device 34 is attached to the casing 12. Therefore, in comparison with the case where the air is taken from the first air intake 96, it becomes possible to take a larger amount of air in the case where the air is taken from the second air intake 58. As a result, even when the heat amount generated by the electrical power supply 26 increases, it is possible to effectively cool the electrical power supply 26.

As shown in FIG. 1, when a wall part of the casing 12 located at an upstream side portion along the conveying direction of the sheet of paper P in the predetermined recording space Q is defined as the front wall part 50*a*, and a wall part of the casing 12 located at a downstream side portion of the conveying direction is defined as the rear wall part 50*b*, the insertion hole 69 to which the cassette 18 is inserted is formed in the front wall part 50*a* of the casing 12. Such a configuration enables a user to easily perform work for attaching or detaching the cassette 18 to or from the casing 12, from the front side of the casing 12. Furthermore, since the sheet of paper P is ejected toward the front side from the paper ejection opening 64 provided at the rear portion of the casing 12, the user is able to pick up the sheet of paper P ejected to the discharge tray 20, from the front side of the casing 12, which enhances workability in relation to the advantages that the cassette 18 can be detached or attached from or to the casing 12 from the front side of the casing. As shown in FIG. 1, the discharge opening 98 for the air flowing through the cooling air flow path 30 is formed in the rear wall part 50*b* of the casing 12, it is possible to prevent the discharged air from hitting against the user performing work from the front side.

As shown in FIG. 3, the air blower 32 is arranged on the downstream side in the air flowing direction in the cooling air flow path 30 with respect to the region where the electrical power supply 26 is provided, it is possible to suck the air inside the casing 12 and to discharged the sucked air. As a result, it becomes possible to prevent the air heated by the electrical power supply 26 from being diffused in the casing 12.

(Other Embodiments)

Figure 7:
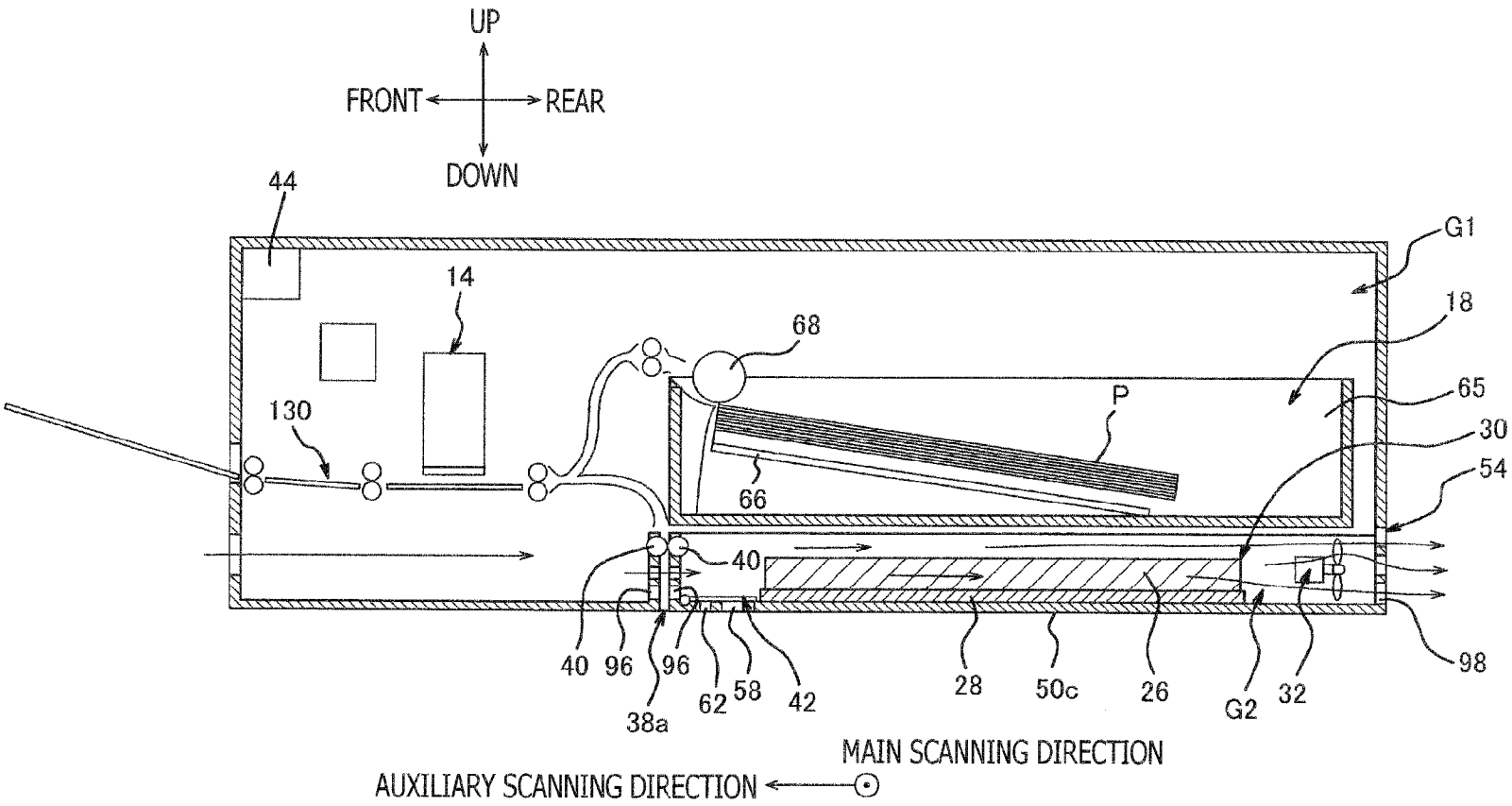
FIG. 7 is a schematic diagram generally illustrating a configuration of an inkjet printer according to another embodiment.

As shown in FIG. 1, in the embodiment, the ink ejection heads 14*a* to 14*d* serving as a recording device are arranged on the upper side of the cassette 18 in the vertical direction. However, in another embodiment, an ink ejection head 14 may be arranged to have the position equal to the position of the cassette 18 in the vertical direction (i.e., to have the height equal to the height of the cassette 18 as shown in FIG. 7. In this case, the electrical power supply 26 and the cooling air flow path 30 are also arranged in the second region G2 under the cassette 18, a conveying path 130 and the ink ejection head 14. Therefore, the air flowing through the cooling air flow path 30 does not het against the sheet of paper P passing through the conveying path 130, and thereby it becomes possible to prevent the air from badly affecting the carrying of the sheet of paper P.

Figure 8:
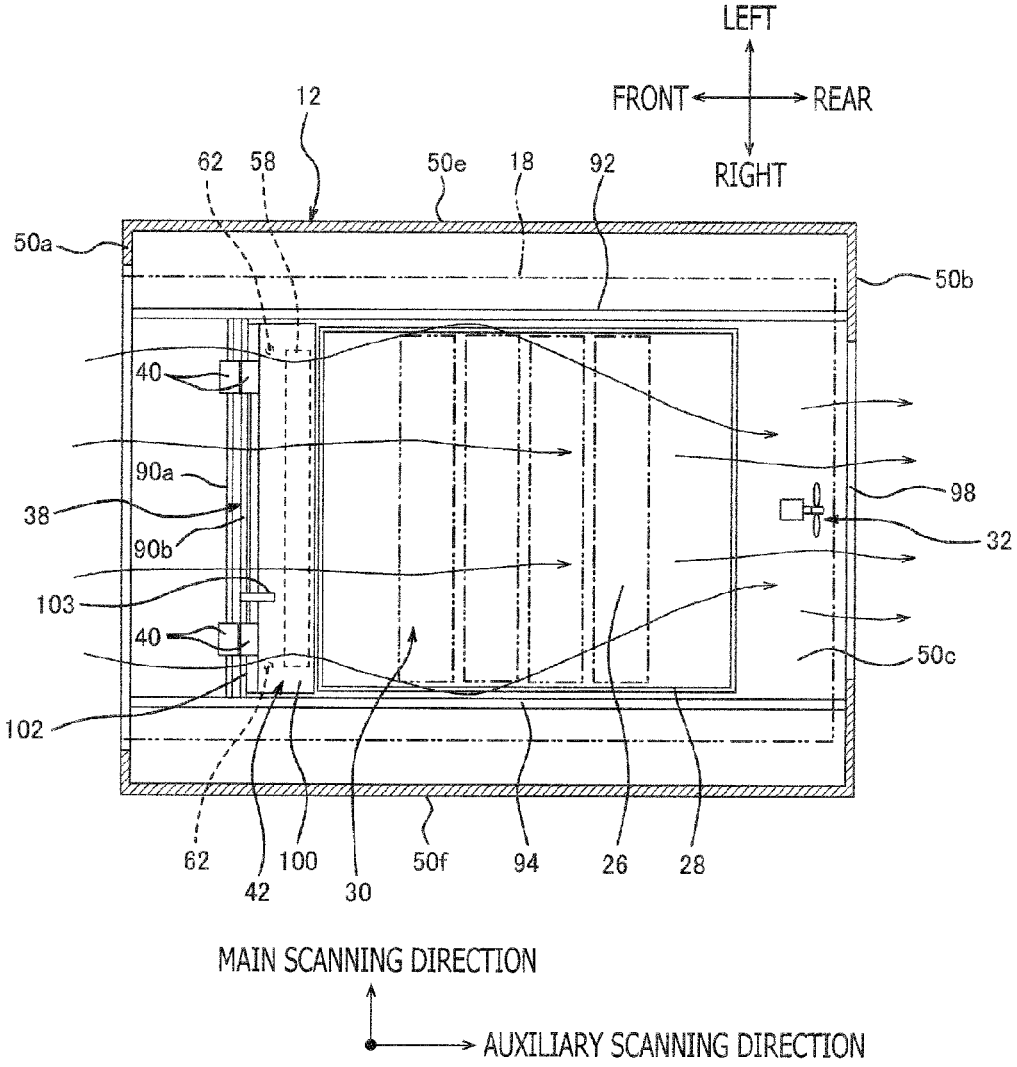
FIG. 8 is a cross sectional view corresponding to FIG. 3, illustrating an inkjet printer according to another embodiment.

As shown in FIG. 2, in this embodiment, the electrical power supply 26 is arranged to depart from the plat parts 92 and 94. However, in another embodiment, the electrical power supply 26 may be arranged to be close the plate parts 92 and 94 as shown in FIG. 8. In this case, since it becomes possible to increase the ratio of air flowing along the surface of the cooling air flow path 30 with respect to the air flowing through the cooling air flow path 30, the cooling capability for the electrical power supply 26 can be enhance. As a way to cause the electrical power supply 26 and the plate parts 29 and 94 to become closer to each other, the length of the electrical power supply 26 in the left and right direction may be increased or the interval between the plate parts 92 and 94 may be decreased as shown n FIG. 8.

As shown in FIG. 1, in the above described embodiment, the present invention is applied to the inkjet printer 10 which ejects ink. However, the present invention may be applied to an image recording apparatus other than the printer, such as a copying machine or a facsimile machine, or may be applied to an image recording apparatus which uses a printing agent (e.g., toner) other than ink. In another embodiment, more than one additional cassette devices 34 may be stacked to have layers.

What is claimed is:

1. An image recording apparatus, comprising:

a recording device configured to record an image on a recording medium in a recording space, the recording space being defined facing the recording device;

a cassette configured to accommodate the recording medium on which the image is to be recorded by the recording device;

a discharge tray configured to stack the recording medium on which the image has been formed by the recording device;

a conveying path along which the recording medium is conveyed from the cassette to the discharge tray via the recording space, wherein the recording space is a part of the conveying path;

a conveyor configured to apply, to the recording medium, a conveying force for conveying the recording medium along the conveying path;

an electrical power supply configured to supply electrical power at least to the conveyer;

a cooling air flow path through which air for cooling the electrical power supply flows;

an air blower configured to apply a wind-force to air so as to cause the air to flow through the cooling air flow path; and a casing that accommodates the recording device, the cassette, the conveying path, the conveyor, the electrical power supply and the cooling air flow path, wherein:

the electrical power supply and the cooling air flow path are arranged in a lower region in a vertical direction with respect to the cassette, the conveying path and the recording device;

the recording device is located, in regard to the vertical direction, at a position higher than or equal to the cassette; and at least a part of the recording space overlaps the electrical power supply when viewed along the vertical direction, wherein the recording space is arranged to be higher than the cassette, in regard to the vertical direction, and to overlap the cassette when viewed along the vertical direction, wherein:

the cassette is formed to extend in a direction parallel to a conveying direction of the recording medium in the recording space; and the cooling air flow path is arranged to extend in a direction parallel to the conveying direction of the recording medium in the recording space, wherein the conveying path comprises:

a first conveying path section; and a second conveying path section, wherein the first conveying path section is located in the recording space, wherein the recording medium, when accommodated in the cassette, is stacked in the vertical direction, and wherein the second conveying path section is located between the cassette and the first conveying path section, and on an upper side with respect to a bottom of the cassette, and wherein the recording device includes an ink ejection head.

2. The image recording apparatus according to claim 1, wherein:

the discharge tray is formed on a top face of the casing in the vertical direction; and the conveying path further comprises:

a discharge path through which the recording medium which has passed the first conveying path section is carried to the discharge tray.

3. The image recording apparatus according to claim 1, wherein:

the casing comprises two wall parts each of which is formed to extend to perpendicularly intersect with the conveying direction of the recording medium in the recording space; and when one of the two wall parts located on an upstream side in the conveying direction of the recording medium in the recording space is defined as a front wall part, and the other of the two wall parts located on a downstream side in the conveying direction is defined as a rear wall part, an insertion hole to which the cassette is inserted is formed in the front wall part.

4. The image recording apparatus according to claim 3, wherein a discharge opening for the air flowing through the cooling air flow path is formed in the rear wall part.

5. The image recording apparatus according to claim 1, wherein the recording space faces the ink ejection head.

6. An image recording apparatus, comprising:

a recording device configured to record an image on a recording medium in a recording space, the recording space being defined facing the recording device;

a cassette configured to accommodate the recording medium on which the image is to be recorded by the recording device;

a discharge tray configured to stack the recording medium on which the image has been formed by the recording device;

a conveying path along which the recording medium is conveyed from the cassette to the discharge tray via the recording space;

a conveyor configured to apply, to the recording medium, a conveying force for conveying the recording medium along the conveying path;

an electrical power supply configured to supply electrical power at least to the conveyer;

a cooling air flow path through which air for cooling the electrical power supply flows;

an air blower configured to apply a wind-force to air so as to cause the air to flow through the cooling air flow path; and a casing that accommodates the recording device, the cassette, the conveying path, the conveyor, the electrical power supply and the cooling air flow path, wherein:

the electrical power supply and the cooling air flow path are arranged in a lower region in a vertical direction with respect to the cassette, the conveying path and the recording device;

the recording device is located, in regard to the vertical direction, at a position higher than or equal to the cassette; and the electrical power supply and the cassette overlap each other in the vertical direction, wherein the image recording apparatus further comprises an additional cassette device that is attached to a lower portion of the casing and is arranged under the casing, wherein the additional cassette device comprises:

an additional cassette configured to accommodate a recording medium on which an image is to be recorded by the recording device;

an additional conveying path along which the recording medium accommodated in the additional cassette is conveyed to the conveying path;

an additional conveyor configured to apply a conveying force to the recording medium so that the recording medium is conveyed along the additional conveying path; and an additional cooling air flow path along which the air for cooling the electrical power supply flows, and wherein:

a relay path is arranged in the casing such that the conveying path communicates with the additional conveying path; and the additional cooling air flow path is arranged to communicate with the cooling air flow path so as to proceed not to intersect with the additional conveying path and the relay path.

7. The image recording apparatus according to claim 6, wherein:

the discharge tray is formed on a top face of the casing in the vertical direction;

the conveying path comprises:

a horizontal path through which the recording medium is carried horizontally in the recording space;

a supply path through which the recording medium accommodated in the cassette is carried to the horizontal path; and a discharge path through which the recording medium which has passed the horizontal path is carried to the discharge tray.

8. The image recording apparatus according to claim 6, wherein:

the cassette is formed to extend in a direction parallel to a conveying direction of the recording medium in the recording space; and the cooling air flow path is arranged to extend in a direction parallel to the conveying direction of the recording medium in the recording space.

9. The image recording apparatus according to claim 6, wherein the air blower applies the wind force to cause the air in the cooling air flow path to flow in a direction parallel to a conveying direction of the recording medium in the recording space.

10. The image recording apparatus according to claim 6, wherein:

the casing comprises two wall parts each of which is formed to extend to perpendicularly intersect with a conveying direction of the recording medium in the recording space; and when one of the two wall parts located on an upstream side in the conveying direction of the recording medium in the recording space is defined as a front wall part, and the other of the two wall parts located on a downstream side in the conveying direction is defined as a rear wall part, an insertion hole to which the cassette is inserted is formed in the front wall part.

11. The image recording apparatus according to claim 10, wherein a discharge opening for the air flowing through the cooling air flow path is formed in the rear wall part.

12. The image recording apparatus according to claim 6, further comprising:

an air intake path that is provided at a region corresponding to an upstream side end portion in the casing in a conveying direction of the recording medium in the recording space, the air intake path introducing air outside the casing into the cooling air flow path via a region in which the relay path is provided;

a first air intake that is arranged in a downstream side end of the air intake path and is configured to introduce the air flowing through the air intake path into the cooling air flow path;

a second air intake that is arranged at a bottom constituting a lower surface of the casing in the vertical direction and is configured to introduce the air in the additional cooling air flow path into the cooling air flow path; and an air intake switch device configured to introduce the air into the cooling air flow path from one of the first air intake and the second air intake, wherein the air intake switch device is configured such that:

when the additional cassette device is not attached to the casing, the air intake switch device introduces the air from the first air intake; and when the additional cassette device is attached to the casing, the air intake switch device introduces the air from the second air intake.

13. The image recording apparatus according to claim 12, wherein:

the electrical power supply supplies electrical power to the conveyor, the additional conveyer and the air blower;

an opening area of the second air intake is larger than an opening area of the first air intake; and in comparison with a case where the additional cassette device is not attached to the casing, the air blower generates greater wind force for causing the air to flow through the cooling air flow path in a case where the additional cassette device is attached to the casing.

14. An image recording apparatus, comprising:

a recording device configured to record an image on a recording medium in a recording space, the recording space being defined facing the recording device;

a cassette configured to accommodate the recording medium on which the image is to be recorded by the recording device;

a discharge tray configured to stack the recording medium on which the image has been formed by the recording device;

a conveying path along which the recording medium is conveyed from the cassette to the discharge tray via the recording space, wherein the recording space is part of the conveying path;

a conveyor configured to apply, to the recording medium, a conveying force for conveying the recording medium along the conveying path;

an electrical power supply configured to supply electrical power at least to the conveyer;

a cooling air flow path through which air for cooling the electrical power supply flows;

an air blower configured to apply a wind-force to air so as to cause the air to flow through the cooling air flow path; and a casing that accommodates the recording device, the cassette, the conveying path, the conveyor, the electrical power supply and the cooling air flow path, wherein:

the electrical power supply and the cooling air flow path are arranged in a lower region in a vertical direction with respect to the cassette, the conveying path and the recording device;

the recording device is located, in regard to the vertical direction, at a position higher than the cassette;

at least a part of the recording space overlaps the electrical power supply when viewed along the vertical direction; and the recording space is arranged to be higher than the cassette, in regard to the vertical direction, and to overlap the cassette when viewed along the vertical direction, wherein the air blower is arranged on a downstream side in an air flow direction with respect to a region where the cooling air flow path and the electrical power supply is arranged, wherein:

the cassette is formed to extend in a direction parallel to a conveying direction of the recording medium in the recording space; and the cooling air flow path is arranged to extend in a direction parallel to the conveying direction of the recording medium in the recording space, wherein the conveying path comprises:

a first conveying path section; and a second conveying path section, wherein the first conveying path section is located in the recording space, wherein the recording medium, when accommodated in the cassette, is stacked in the vertical direction, wherein the second conveying path section is located between the cassette and the first conveying path section, and on an upper side with respect to a bottom of the cassette, and wherein the recording device includes an ink ejection head.

15. The image recording apparatus according to claim 14, wherein:

the discharge tray is formed on a top face of the casing in the vertical direction; and the conveying path further comprises:

a discharge path through which the recording medium which has passed the first conveying path section is carried to the discharge tray.

16. The image recording apparatus according to claim 14, wherein:

the casing comprises two wall parts each of which is formed to extend to perpendicularly intersect with the conveying direction of the recording medium in the recording space; and when one of the two wall parts located on an upstream side in the conveying direction of the recording medium in the recording space is defined as a front wall part, and the other of the two wall parts located on a downstream side in the conveying direction is defined as a rear wall part, an insertion hole to which the cassette is inserted is formed in the front wall part.

17. The image recording apparatus according to claim 16, wherein a discharge opening for the air flowing through the cooling air flow path is formed in the rear wall part.

18. The image recording apparatus according to claim 14, wherein the recording space faces the ink ejection head.

19. An image recording apparatus, comprising:

a recording device configured to record an image on a recording medium in a recording space, the recording space being defined facing the recording device;

a cassette configured to accommodate the recording medium on which the image is to be recorded by the recording device;

a discharge tray configured to stack the recording medium on which the image has been formed by the recording device;

a conveying path along which the recording medium is conveyed from the cassette to the discharge tray via the recording space;

a conveyor configured to apply, to the recording medium, a conveying force for conveying the recording medium along the conveying path;

an electrical power supply configured to supply electrical power at least to the conveyer;

a cooling air flow path through which air for cooling the electrical power supply flows;

an air blower configured to apply a wind-force to air so as to cause the air to flow through the cooling air flow path; and a casing that accommodates the recording device, the cassette, the conveying path, the conveyor, the electrical power supply and the cooling air flow path, wherein:

the electrical power supply and the cooling air flow path are arranged in a lower region in a vertical direction with respect to the cassette, the conveying path and the recording device;

the recording device is located, in regard to the vertical direction, at a position higher than or equal to the cassette; and at least a part of the recording space overlaps the electrical power supply when viewed along the vertical direction, wherein the recording space is arranged to be higher than the cassette, in regard to the vertical direction, and to overlap the cassette when viewed along the vertical direction, wherein:

the cassette is formed to extend in a direction parallel to a conveying direction of the recording medium in the recording space; and the cooling air flow path is arranged to extend in a direction parallel to the conveying direction of the recording medium in the recording space, wherein the conveying path comprises:

a first conveying path section; and a second conveying path section, wherein the first conveying path section is located in the recording space, wherein the recording medium, when accommodated in the cassette, is stacked in the vertical direction, and wherein the second conveying path section is located between the cassette and the first conveying path section, and on an upper side with respect to a bottom of the cassette, wherein:

a length of the cassette is greater than a length of the electric power supply in the conveying direction;

the length of the electric power supply is greater than a length of the recording space in the conveying direction;

the electric power supply is arranged within an extent of the cassette, in the conveying direction; and the recording space is arranged within an extent of the electric power supply in the conveying direction.

20. An image recording apparatus, comprising:

a recording device configured to record an image on a recording medium in a recording space, the recording space being defined facing the recording device;

a cassette configured to accommodate the recording medium on which the image is to be recorded by the recording device;

a discharge tray configured to stack the recording medium on which the image has been formed by the recording device;

a conveying path along which the recording medium is conveyed from the cassette to the discharge tray via the recording space;

a conveyor configured to apply, to the recording medium, a conveying force for conveying the recording medium along the conveying path;

an electrical power supply configured to supply electrical power at least to the conveyer;

a cooling air flow path through which air for cooling the electrical power supply flows;

an air blower configured to apply a wind-force to air so as to cause the air to flow through the cooling air flow path; and a casing that accommodates the recording device, the cassette, the conveying path, the conveyor, the electrical power supply and the cooling air flow path, wherein:

the electrical power supply and the cooling air flow path are arranged in a lower region in a vertical direction with respect to the cassette, the conveying path and the recording device;

the recording device is located, in regard to the vertical direction, at a position higher than the cassette;

at least a part of the recording space overlaps the electrical power supply when viewed along the vertical direction; and the recording space is arranged to be higher than the cassette, in regard to the vertical direction, and to overlap the cassette when viewed along the vertical direction, wherein the air blower is arranged on a downstream side in an air flow direction with respect to a region where the cooling air flow path and the electrical power supply is arranged, wherein:

the cassette is formed to extend in a direction parallel to a conveying direction of the recording medium in the recording space; and the cooling air flow path is arranged to extend in a direction parallel to the conveying direction of the recording medium in the recording space, wherein the conveying path comprises:

a first conveying path section; and a second conveying path section, wherein the first conveying path section is located in the recording space, wherein the recording medium, when accommodated in the cassette, is stacked in the vertical direction, and wherein the second conveying path section is located between the cassette and the first conveying path section, and on an upper side with respect to a bottom of the cassette, wherein:

a length of the cassette is greater than a length of the electric power supply in the conveying direction;

the length of the electric power supply is greater than a length of the recording space in the conveying direction;

the electric power supply is arranged within an extent of the cassette, in the conveying direction; and the recording space is arranged within an extent of the electric power supply in the conveying direction.

* * * * *